US007201312B2

(12) United States Patent
Fumanelli

(10) Patent No.: US 7,201,312 B2
(45) Date of Patent: Apr. 10, 2007

(54) DEVICE TO INVALIDATE BANKNOTES IN A UNIT EQUIPPED FOR THE STORAGE THEREOF

(75) Inventor: Giuseppe Ezio Fumanelli, Melzo (IT)

(73) Assignee: M.I.B. S.p.A., Peschiera Borromeo (IT)

( * ) Notice: Subject to any disclaimer, the term of this patent is extended or adjusted under 35 U.S.C. 154(b) by 0 days.

(21) Appl. No.: 10/952,170

(22) Filed: Sep. 29, 2004

(65) Prior Publication Data

US 2005/0121508 A1 Jun. 9, 2005

(30) Foreign Application Priority Data

Sep. 29, 2003 (IT) ..... MI2003A1861

(51) Int. Cl.

| | |
|---|---|
| ***G06Q 40/00*** | (2006.01) |
| ***G07D 11/00*** | (2006.01) |
| ***G07F 19/00*** | (2006.01) |
| ***E05G 1/00*** | (2006.01) |
| ***G08B 13/22*** | (2006.01) |
| ***G08B 15/00*** | (2006.01) |
| ***G08B 15/02*** | (2006.01) |
| ***F41C 9/00*** | (2006.01) |

(52) U.S. Cl. ..... 235/379; 902/8; 902/9; 902/13; 109/25; 109/35; 109/36; 109/33

(58) Field of Classification Search ..... 235/379–381, 235/487, 486, 462.01, 462.13; 902/8, 9, 902/13, 14–16, 38, 7; 705/40–45, 62, 67; 209/534; 109/20, 24.1, 25, 33, 36–37, 41, 109/45, 35; 283/72, 103

See application file for complete search history.

(56) References Cited

U.S. PATENT DOCUMENTS

| | | | | |
|---|---|---|---|---|
| 2,037,820 | A * | 4/1936 | Peo | 188/309 |
| 3,349,729 | A * | 10/1967 | Olivier | 109/25 |
| 4,061,436 | A * | 12/1977 | Durrer | 408/3 |
| 4,236,463 | A * | 12/1980 | Westcott | 109/33 |
| 5,952,920 | A * | 9/1999 | Braddick | 340/568.1 |
| 6,247,415 | B1 * | 6/2001 | Appeltans et al. | 109/33 |
| 6,259,366 | B1 | 7/2001 | Lindskog et al. | |
| 6,321,980 | B1 * | 11/2001 | Yazumi et al. | 235/379 |
| 6,365,880 | B1 * | 4/2002 | Kikuchi et al. | 219/479 |
| 6,679,422 | B2 * | 1/2004 | Brown et al. | 235/379 |
| 2003/0116478 | A1 * | 6/2003 | Laskowski | 209/534 |
| 2003/0141372 | A1 * | 7/2003 | Brown et al. | 235/487 |
| 2004/0007165 | A1 * | 1/2004 | Abe et al. | 109/20 |
| 2004/0144569 | A1 * | 7/2004 | Pritchard et al. | 175/99 |

FOREIGN PATENT DOCUMENTS

| | | | |
|---|---|---|---|
| EP | 0035980 | A1 | 9/1981 |
| EP | 0866202 | A1 | 9/1998 |
| FR | 2676085 | A1 | 11/1992 |
| GB | 1112934 | A | 5/1968 |
| GB | 1161869 | A | 8/1969 |
| JP | 2004355270 | A * | 12/2005 |
| WO | WO 03/064798 | A1 | 8/2003 |

* cited by examiner

*Primary Examiner*—Daniel Walsh
(74) *Attorney, Agent, or Firm*—Browdy and Neimark, PLLC

(57) ABSTRACT

A device is disclosed to invalidate banknotes in a unit equipped for the storage thereof, comprising an ignition unit (15) placed in the equipped unit (3) in a position adjacent to the banknotes (4) and suitable to generate a flame producing on the banknotes (4) localized burns (4*a*) of a pre-established and identifiable type, the ignition unit (15) being controlled by activation means (16) sensitive to alarm situations.

15 Claims, 5 Drawing Sheets

2a
3
9a
9
3b
13
17
15
4
5a
3a
1
13
9a
9
17
15
4
5a
5
7
3
2
8
6
6b
14
6a
11
10b
10a
12

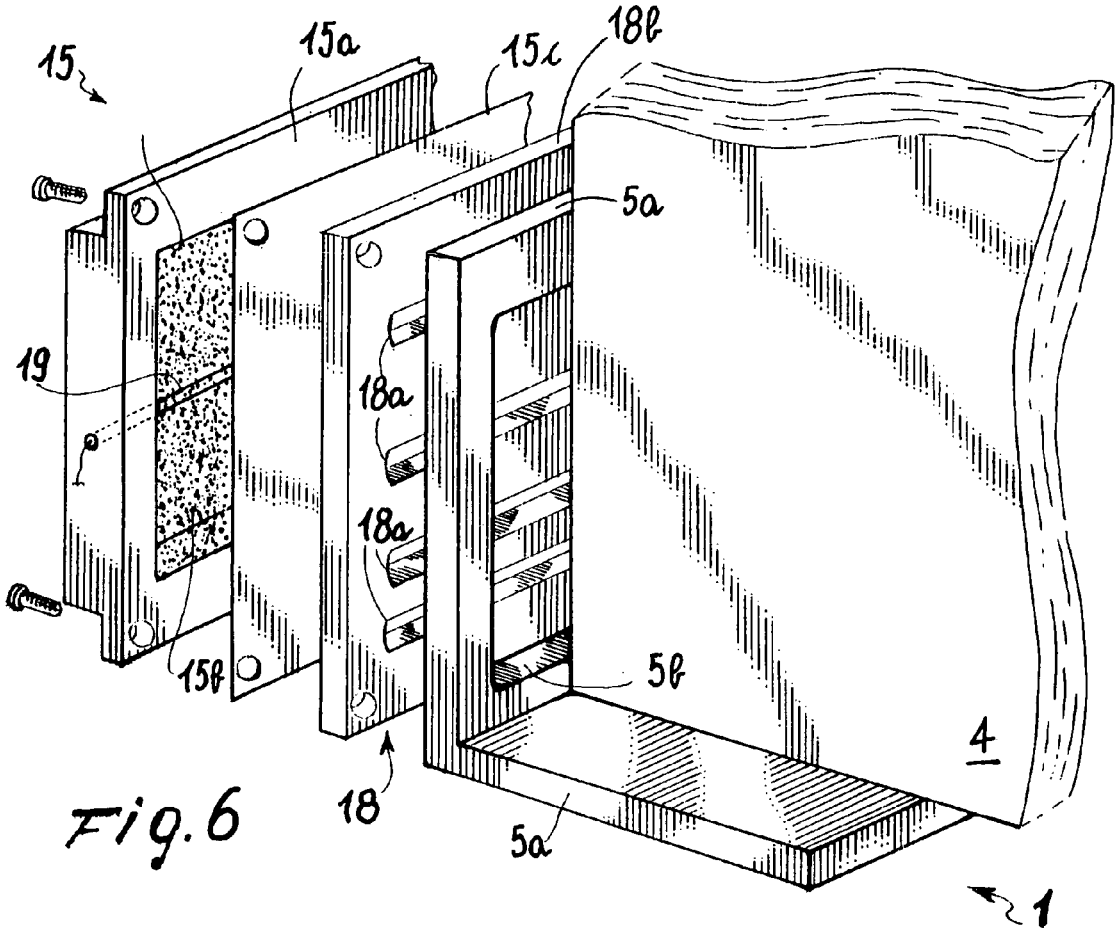
Fig. 6
Fig. 7
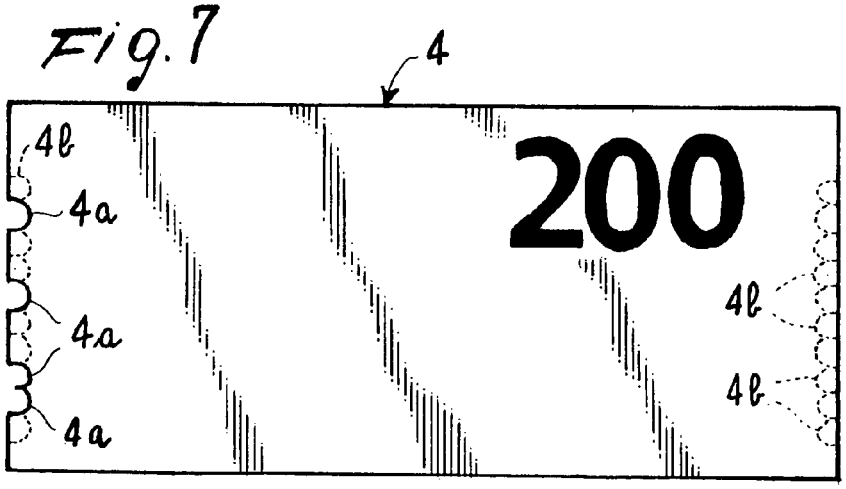

3b
3a
15
15a
18b
5
5a
3
200
4
5a
18b
15
17
1
15a
9a
20
21
16
2
2

DEVICE TO INVALIDATE BANKNOTES IN A UNIT EQUIPPED FOR THE STORAGE THEREOF

TECHNICAL FIELD OF THE INVENTION

The invention relates to a device to invalidate banknotes and the like in a unit equipped for the storage thereof, and including a plurality of banknotes forming at least one orderly group. The equipped unit is for example a safe, a banknote and cash dispensing machine of the type called "Bancomat" or "ATM" (Automatic Teller Machine), a banknote storage cassette of the type utilized in said machine.

DESCRIPTION OF PRIOR ART

As is known, inside banknote and cash dispensing machines called "Bancomat" or "ATMs" there are storage cassettes wherein banknotes or valuables are arranged in orderly rows or piles. These storage cassettes are extractable to be periodically opened and refilled with banknotes and are generally connected both to equipment to handle the banknotes to supply counted quantities thereof, and to active protection members.

A first type of active protection member is constituted by a staining device, capable of delivering a coloring or staining fluid to the banknotes.

The staining device may prevalently be on the inside or outside of the storage cassettes and desirably the staining fluid is capable of leaving traces on the banknotes which are to as great extent possible indelible, so that they are no longer usable and consequently to discourage attempts of theft.

A second type of active protection member is constituted by an extinguishing and anti-explosion device, capable of preventing, by delivery of specific substances, such as an inert gas like nitrogen or carbon dioxide, detonation in "Bancomat" or "ATMs" of explosive fluids, introduced from the outside through the small holes existing for locks or the slots through which the banknotes are delivered. Explosion is attempted to open the casing, at least partly armored, of "Bancomat" and "ATMs" and thereby gain access to the cassettes and their content.

In some cases delivery of inert gases also takes place in the spaces inside the cassettes as it is desirable not only to prevent an explosion and the consequent damages and risks, but also to prevent incineration of the banknotes in the cassettes, as a consequence of the high temperatures developed with an explosion and/or a fire caused by thefts based on the use of thermal means such as a thermal lance.

In fact, while the stained banknotes are in any case easily identifiable, according to denomination and serial number, incinerated banknotes offer no identification to allow banks to replace them: in order to be replaced the banknotes must be identifiable.

In the case of totally incinerated banknotes, the damage suffered is not therefore recoverable.

Said active protection members are at times unsatisfactory and in particular the staining device can for various reasons be ineffective.

In fact, solvents which partly attenuate the staining fluid can be applied to stained banknotes.

Moreover, some important parts of a banknote, for example the hologram or other parts with reduced absorbency are stained only to a limited extent.

These drawbacks are serious as they can reduce the main element of dissuasion: the present or future economic worthlessness of attempts of theft.

The drawback does not appear solvable at the root through the careful choice of staining fluid, as it is possible that new solvents or detergents capable in any case of acting on the staining fluid without interacting with the inks of the banknotes may be developed.

Another drawback concerning the use of a coloring or staining fluid is that the origin of stained banknotes is not easily identifiable when they are recovered or found outside the zone in which they were stolen.

In fact, accurate laboratory testing is required both for positive identification of the presence on recovered banknotes of an ink of the type used to discourage thefts, and to identify the origin of the banknotes on the basis of the particular chemical composition of the ink.

This testing requires a certain amount of time which, in the case of urgent investigations, may be inappropriate. Moreover, testing is costly, requiring the use of specific equipment and skilled personnel.

SUMMARY OF THE INVENTION

In this situation the technical task of the invention is to devise a device which is able to overcome the aforesaid drawbacks.

The technical task is obtained by a device to invalidate banknotes in a unit equipped for the storage thereof, said equipped unit including banknotes forming at least one orderly group and the device comprising at least one ignition unit placed in said equipped unit in a position adjacent to said banknotes and suitable to generate at least one flame producing on said banknotes localized burns of a pre-established and identifiable type, activation means of said ignition unit sensitive to alarm situations being provided.

BRIEF DESCRIPTION OF THE DRAWINGS

The description of preferred embodiments of the invention is now provided, by way of example, with reference to the accompanying drawings, wherein:

FIG. 6 shows a perspective and exploded view of a variant of FIG. 5;

FIG. 7 shows a possible effect of the device, in the embodiment in FIG. 6, on a banknote.

DESCRIPTION OF PREFERRED EMBODIMENTS

With reference to the aforesaid figures, the device according to the invention to invalidate banknotes is indicated as a whole with the number 1.

It is introduced in a unit equipped for the storage of banknotes, which may consist in a safe, a banknote or cash dispensing machine or simply a banknote storage cassette of the type utilized in said machine.

Figure 1:
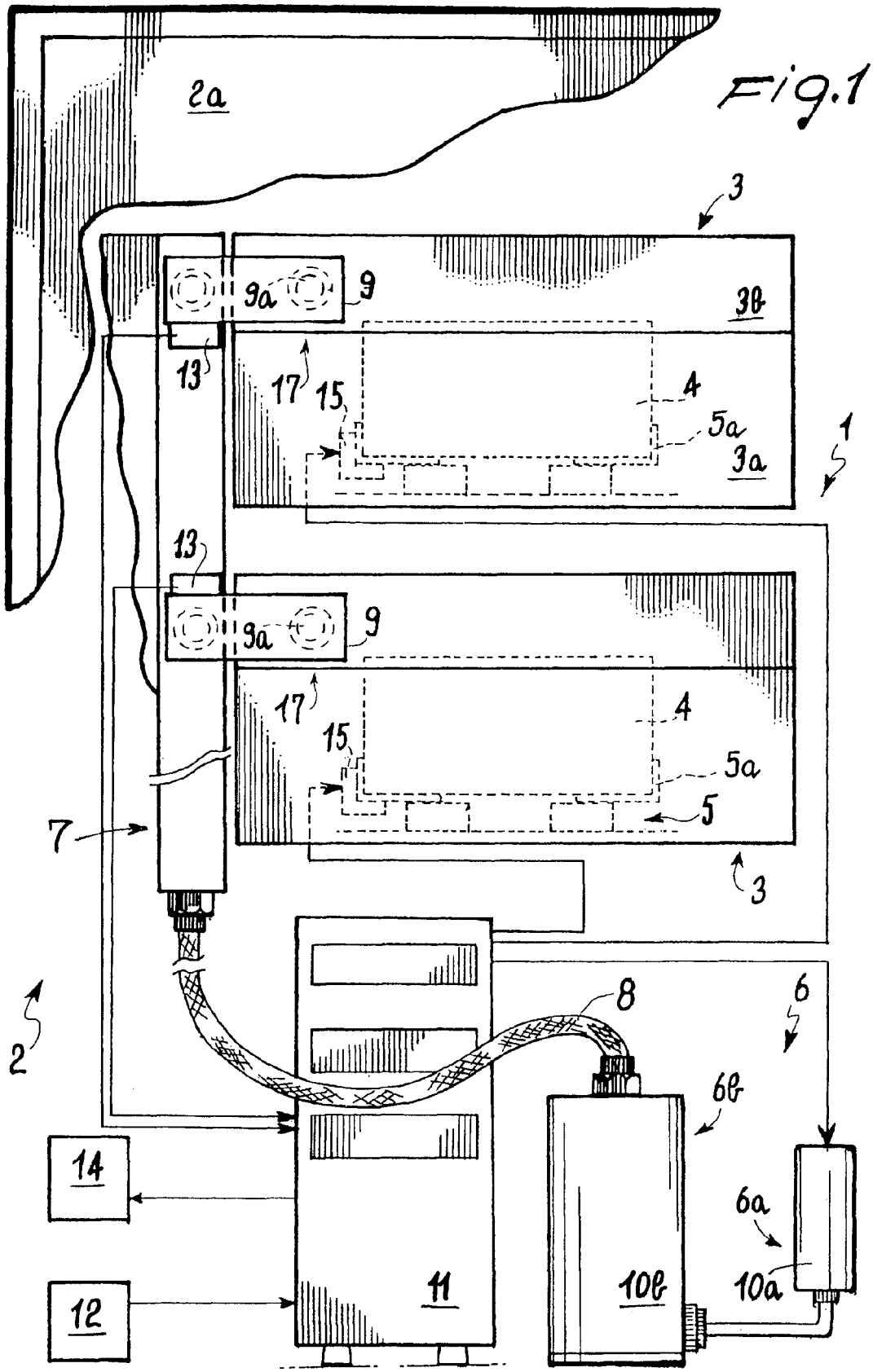
FIG. 1 schematically represents a "Bancomat" or "ATM" equipped with the device according to the invention.

In particular, FIG. 1 schematically represents a banknote dispensing machine 2 such as a "Bancomat" or "ATM", equipped with a casing 2*a*, at least partly armored, and including as internal members one or more storage cassettes 3 for banknotes 4 forming at least one orderly group.

Each storage cassette 3 consists more specifically in an equipped unit. In a known way, the storage cassettes 3 are extractable from the automatic dispenser 2 and can be opened due to the presence of a base 3*a* and a cover 3*b*. They are provided with various internal members, in particular guiding means 5 for the banknotes, which are disposed in orderly groups, forming orderly piles or rows supported and positioned by said guiding means 5.

These means have guiding sides 5*a* defined by rigid slats or squares which position and support the banknotes 4.

Generally, each storage cassette 3 includes banknotes of the same denomination and is correlated to equipment to handle said banknotes to supply counted quantities thereof, upon request from the user.

The machine 2 preferably includes active protection members 6 defined by an extinguishing device 6*a* suitable to deliver an extinguishing fluid and by a staining device 6*b* suitable to deliver a staining fluid.

Both fluids are conveyed by means of channeling members 7 to the equipped units or storage cassettes 3.

Different embodiments of the active protective members 6 can be provided and in particular the extinguishing device 6*a* and the staining device 6*b* can be entirely separate and independent from each other.

In the embodiment shown in FIG. 1, the two devices are combined with each other and the channeling members 7 comprise a single channel 8 and extractable terminal connections 9 placed at the level of the storage cassettes 3.

Provided inside the cassettes are perforated coils 9*a* extending from the terminal connections 9 and suitable to deliver said fluids to the banknotes 4.

To channel both fluids along the single channel 8, the extinguishing device 6*a* and the staining device 6*b* comprise respectively a first and a second reservoir 10*a* and 10*b*, in series with each other, and the extinguishing fluid of the first reservoir 10*a* acts as propellant for the staining fluid of the second reservoir 10*b*.

The second reservoir 10*b* is therefore not pressurized and the first reservoir 10*a* preferably consists in an aerosol generator which when activated is capable of delivering an extinguishing particulate chemically combinable with oxygen, to nullify the capacity of the latter to act as combustion agent in explosions and fires. Said extinguishing aerosol generator has a cylindrical body, in the form of a cartridge, can be activated by an electric resistance and creates a short flame upstream of the flow of extinguishing particulate. It is described for example in the patent EP 0 871 516 by Dynamit Nobel GmbH.

Another embodiment of the extinguishing fluid can be defined by a foaming substance, suitable to smother combustion, for example a chemical foam of the type used in fire extinguishers.

The electrical signal to activate the aerosol generator 10*a*, and in general the active protection members 6, is transmitted by a control centre 11 of the electronic type. The control centre 11 is connected to various sensors 12, of known type, for example suitable to detect forcing and breakage of the casing 2*a*, procedures to open said casing with methods that are not permitted, movement of the casing, the presence of explosive gases, etc.

The control centre 11 then receives the signals of detectors 13 suitable to identify the position of extraction or incorrect positioning of the cassettes 3.

In turn the control centre 11 is capable of activating external alarms 14, in a known way.

The device 1 according to the invention provides new active protection, which can advantageously be integrated and combined with those of the aforesaid type, and capable of nullifying or obliterating banknotes.

The device 1 comprises one or more ignition units 15 placed in each storage cassette 3 and suitable to produce a flame and to determine on the banknotes 4, by means of said flame, localized burns or incisions 4*a* of pre-established and identifiable type.

In the preferred embodiment, each ignition unit 15 is activated or ignited by activation means 16, is controlled by restricting means 17, to restrict or limit the effects of the flame produced by the ignition unit on the banknotes 4, and has conveying means 18 of the flame suitable to direct said flame with precision, to burn in a localized and identifiable way pre-established areas of the banknotes 4. In detail, the ignition unit 15 is engaged in any suitable position in the storage cassette 3, for example on the base 3*a* or under the cover 3*b* or side by side with the guiding means 5 of the banknotes. The position is determined by the points in which the localized burns or incisions 4*a* are to be produced.

By way of example, the embodiment shown in the figures has a single ignition unit 15 (in FIGS. 1, 2, 3, 5, 6) or two ignition units 15 (in FIG. 8) always placed at the level of the guiding means 5.

The ignition units 15 can be structured in various ways.

For example, they can be thin strips of pyrotechnic material, each of which is capable of producing, when ignited, a localized burn 4*a*.

Nonetheless, ignition units 15 capable of producing a single flame, guided by said conveying means 18, are preferably provided.

In the drawings, the ignition units 15 consist in a shell 15*a* fixed removably to any suitable internal portion of each storage cassette 3, including the cover 3*b*.

In particular, the shell 15*a* is shown fixed by means of screws to a guiding side 5*a* in the shape of a square.

An ignitable substance 15*b*, for example a pyrotechnic powder charge, is inserted in the shell 15*a*.

This is held in place by a sheet 15*c*, for example made of plastic or paper, which burns immediately when the activation means 16 determine ignition of the ignitable substance 15*b*.

In practice, the sheet 15*c* covers an outlet mouth of the flame or in any case an opening of the shell facing the banknotes 4, to allow the flame to be delivered from the shell 15*a* towards the banknotes.

Said conveying means 18 of the flame are provided to direct the flame with precision towards one or more pre-established areas of the banknotes 4, to produce localized burns 4*a* in said areas.

In the preferred embodiment shown in the figures, the conveying means 18 consist in one or more small slotted channels 18*a* interposed between the banknotes 4 and the ignition units 15.

Figure 2:
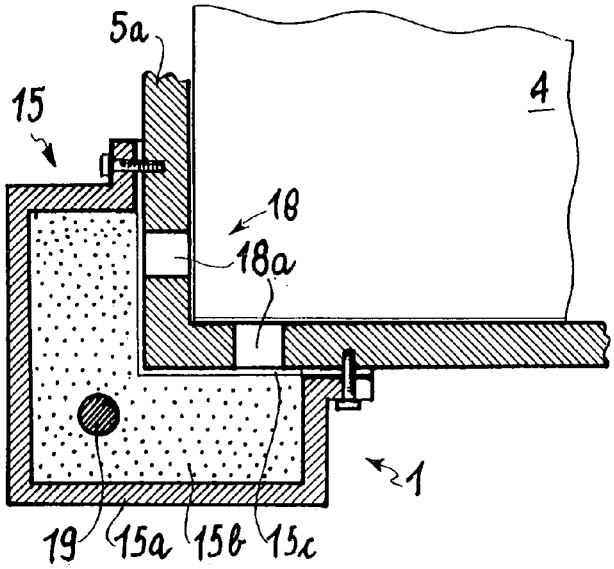
FIG. 2 shows sectional views of some members represented with dashed lines in FIG. 1.
Figure 3:
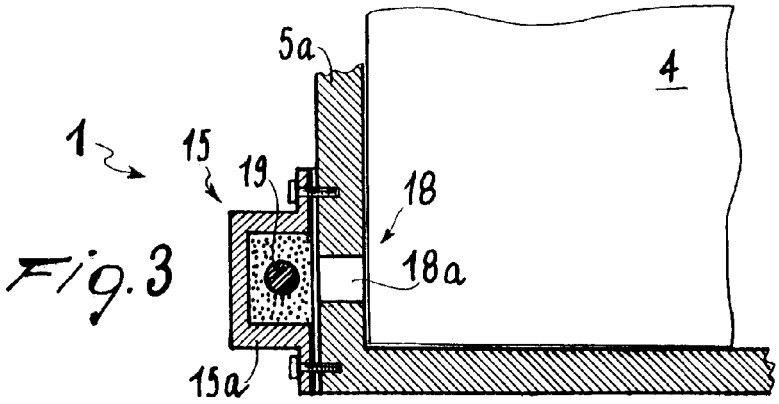
FIG. 3 shows a sectional view of a variant of FIG. 2.
Figure 4:
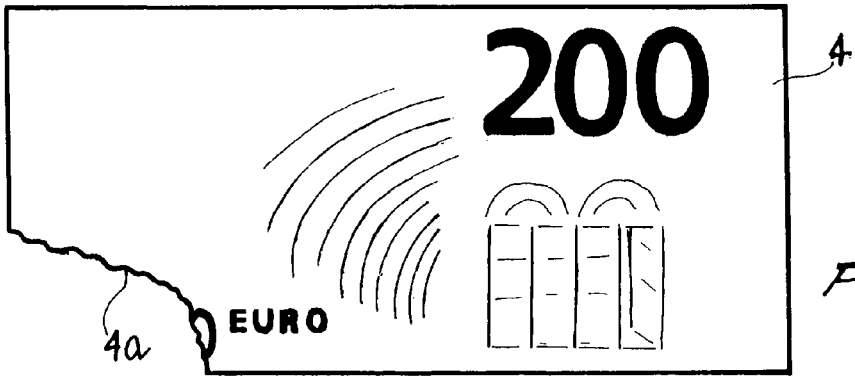
FIG. 4 shows a possible effect of the device, in the embodiments of FIGS. 2 and 3, on a banknote.
Figure 5:
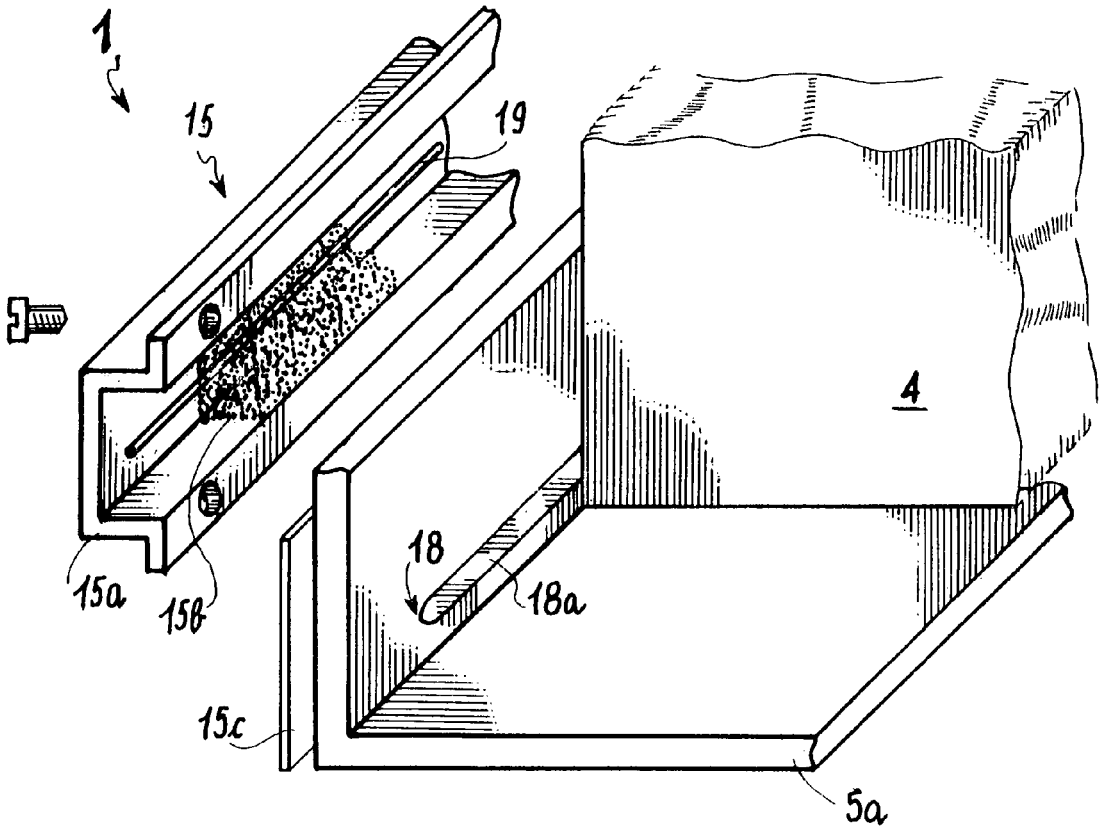
FIG. 5 shows a perspective and exploded view of the members of the device shown in section in FIG. 3.

For example, in FIG. 3 and in FIG. 5 a single slot 18*a* is provided, in FIG. 2 two slots 18*a* are provided and in FIG. 6 a plurality of slots 18*a* are provided. The slots 18*a* are produced directly in the slats or squares forming the guiding sides 5*a*, as in FIGS. 2, 3, 5 or in a specific grooved plate 18*b*, as in FIG. 6. The grooved plate 18*b* is also shown associated with a guiding side 5*a* and therefore the latter has a through cavity 5*b* so that the flow of the flame controlled and guided by the grooved plate 18*b* is not obstructed.

The grooved plate 18*b* can be housed in a respective pocket seat, to allow rapid insertions of said plate, or its replacement with other differently grooved plates. In the case shown in FIG. 6 the pocket seat can be provided at the level of a guiding side 5*a*.

The structure of FIG. 6, which shows a grooved plate provided with various slotted channels 18*a*, is advantageous as the numerous localized burns or incisions 4*a* which are obtained with these slits can simulate a sort of bar code. FIG. 7 shows four localized burns or incisions 4*a*, but many areas for incision can easily be provided along one or more edges of each banknote.

For example, if ten potential incisions 4*b* exist along a side edge of each banknote 4 and the possibility of obtaining at will a number of burnt areas 4*a*, with positioning at will, is considered, more than a thousand different possibilities of coding or identification of the banknotes are possible.

If two side edges of each banknote are incised in a coded way and if ten potential incisions 4*b* are considered on each edge, the total coding possibilities are increased to more than a million.

The activation means 16 determine ignition of the ignition units in the presence of alarm situations.

They can be variably structured and in the cases shown comprise a detonator 19 which can be activated electrically and in contact with the ignitable substance 15*b*, consisting for example in an electric resistance, as shown in the figures, or in a powder microcharge.

Figure 8:
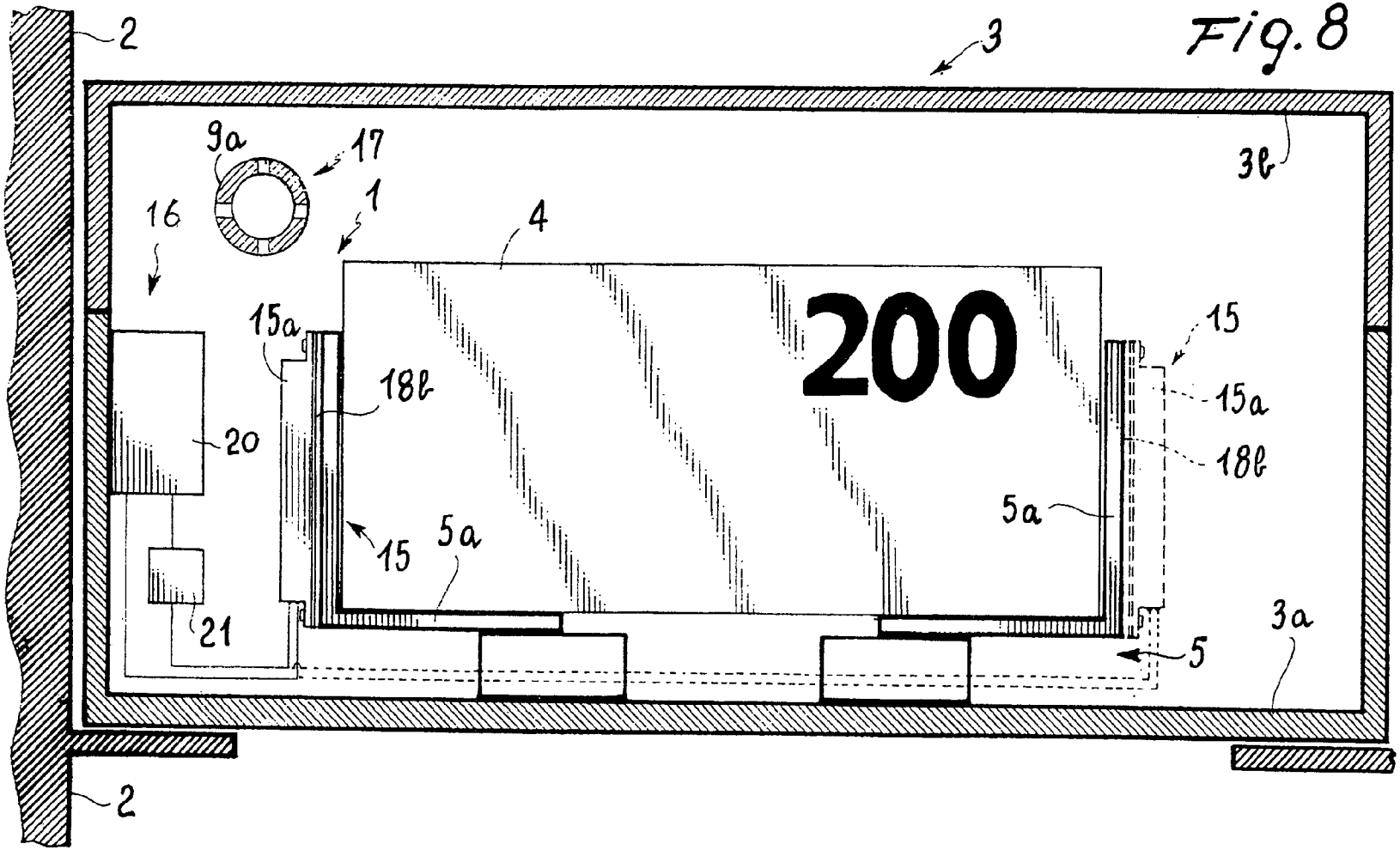
FIG. 8 shows a sectional view of a cassette of a "Bancomat" or "ATM" equipped with the device, in an embodiment thereof housed entirely in the cassette.

The electric signal to activate the detonator 19 can be sent from the control centre 11, as shown in FIG. 1, or the activation means 16 of the ignition unit 15 can be inserted entirely in the equipped units or storage cassettes 3, as shown in FIG. 8.

In this case, the activation means 16 comprise, besides the detonator 19, an electric accumulator 20 and at least one activation sensor 21 inserted between the detonator 19 and the accumulator 20 and suitable to allow passage of electric current in the detonator 19 in pre-established conditions in the equipped unit 3. The activation sensor 21 can for example be a receiver for external alarms, or a pressure switch suitable to detect the passage of a pressurized fluid sent from the active protection members 6 at the level of respective equipped unit or storage cassette 3.

In fact, advantageously, not only can the activation means 16 be active in combination with the active protection members 6, but can also be interlocked with them, so that actuation of the active protection members 6 actually determines the action of the activation means 16.

It must be mentioned that the fluids emitted by the active protection members 6 on the banknotes 4 are supplied at high pressures, which can be detected by the sensor or pressure switch 21, and that advance arrival of the extinguishing fluid does not prevent ignition of the ignitable substance 15*b* and consumption thereof by combustion, which take place with extreme rapidity.

Nonetheless, the extinguishing fluid delivered from the extinguishing device 6*a* ensures that the part removed by burning of the banknotes is restricted and limited, preventing combustion from spreading.

The staining fluid delivered by the staining device 6*b*, if of suitable composition, can also have a restricting effect on the burns 4*a* on the banknotes.

In practice, said restricting means 17 are produced, in the embodiment described, by the active protection members 6, due to their prompt actuation and preferably which itself determines the activation signal of the ignition units.

If the extinguishing fluid and the staining fluid are channeled together towards the banknotes 4, as indicated in FIG. 1, all the staining, burning and limiting operations thereof take place with maximum rapidity and efficacy.

If the extinguishing fluid and the staining fluid are sent under pressure separately, activation of the ignition unit 15 can be interlocked with the first fluid sent.

Moreover, a cartridge of extinguishing aerosol generator 10*a*, of the aforesaid type, can be housed directly in each equipped unit or cassette 3.

Originally, the ignitable substance 15*b* can essentially be defined by extinguishing material of an extinguishing aerosol generator 10*a* which—as already mentioned—produces a short flame, upstream of the particulate. Therefore, while the extinguishing aerosol is delivered, the short flame required to produce localized burns 4*a* is also generated.

The device described above performs a procedure consisting in burning—in an alarm situation—pre-established and limited parts of the banknotes 4 stored in an equipped unit 3, to produce thereon one or more localized burns or incisions 4*a* of identifiable type and which prevent use of the incised banknotes.

It is provided that corners of the banknotes or areas including important elements for determination of the validity of the banknotes, such as the areas with holograms or the like, are burnt.

Moreover, it is possible to burn a plurality of areas on each banknote to obtain localized burns or incisions 4*a* which simulate a bar code with useful information for subsequent checks.

Moreover, it is also provided that implementation of the incisions 4*a* is also controlled and restricted with specific parts, to limit the burns to those strictly necessary and prevent extension thereof which make the banknotes unidentifiable. Control is implemented by means of actuation of the active protection members 6, which are activated essentially simultaneously to localized burning of the banknotes.

Moreover, the signal to activate localized burning of the banknotes can be provided by said actuation of the active protection members 6.

The localized burns can also be produced by means of the initial flame of said extinguishing fluid, when it is an aerosol of the type specified.

The invention obtains important advantages.

In fact, pyrotechnic obliteration or pyrotechnic incision of the banknotes has been implemented to guarantee the nullification thereof, overcoming all problems of efficiency of prior art active protection devices.

The localized burns 4*a* are provided at one or more corners of the banknotes, or along the edges thereof, or at the level of the area of the banknote provided with a hologram or another element that specifically determines authenticity of the banknotes.

It is evident that a banknote without corners or with hologram or incised as described can no longer be used, although the value and serial number remain identifiable.

Obliteration takes place rapidly and with simple means that can be housed in an equipped unit, transportable and/or insertable in a "Bancomat" or "ATM".

Obliteration can also take place by identifying the banknotes in an unequivocal way, so as to mark their origin with certainty.

In fact, by providing suitably positioned slots 18*a* it is possible to obtain localized burns that indicate the equipped unit in which nullification of the banknotes took place.

If the slots 18*a* are applied to a grooved plate 18*b* which is, for example, replaced each time the equipped unit 3 is opened to be checked or refilled, the localized burns 4*a* can provide further indications, for example regarding the specific batch of banknotes inserted and/or the date of their insertion, and/or the date of nullification, and the like.

In this way, the obliterated banknotes do not require to be sent to laboratories to identify the origin, and identification can be performed with extreme rapidity, and without substantial costs. In this way investigations related to finding obliterated banknotes are also facilitated.

The pyrotechnic incision devised has maximum efficiency, rapidity and safety even with banknotes of different face values or packed together tightly side by side, and even if the banknotes housed are combined in bundles and simple wrapping. There is no risk of incineration of the banknotes, as extremely localized burning is implemented and action is taken immediately, or even in advance, with restricting means preferably comprising an extinguishing fluid capable of preventing the burn from spreading.

The device has low costs due to the fact that, as it can be controlled directly by the active protection members, it does not require complex sensorial structures and elaborate operational logic: it uses those already developed for the active protection members.

The invention is susceptible to modifications and variants coming within the scope of the inventive concept.

For example, various members can be provided to channel the extinguishing fluid with precision inside the equipped units, for example to direct the fluid to the ignition units.

The ignition units can also have various shapes and positions.

For example, they can be disposed so as to produce numerous small localized burns simulating a bar code, and a further larger burn, for example at the level of one corner or of a hologram. In this way it becomes clearly impossible to use the banknotes, although they are still identifiable, for example by their value and serial number. This identification allows banks to request the replacement of these banknotes.

Moreover, the ignition units can be disposed in any position in the equipped units, depending on the localized burns to be produced and on the spaces available. The pyrotechnic substances utilized can be selected from a wide range, so as to pre-establish according to choice the rapidity and amplitude of action thereof, and the amplitude of the incisions implemented.

The invention claimed is:

1. A device to invalidate banknotes in a unit equipped for storage thereof, said equipped unit including banknotes (4) forming at least one orderly group, and said device comprising:

at least one ignition unit (15) placed in said equipped unit (3) in a position adjacent to said banknotes (4) and suitable to generate a flame, conveying means (18) of said flame comprising slotted channels (18*a*) produced between said banknotes (4) and said ignition unit (15), said ignition unit (15) and said conveying means (18) producing on at least one of said banknotes (4) a plurality of localized burns (4*a*) adjacent to one another and substantially defining an identifiable coding pattern, and activation means (16) of said ignition unit (15) sensitive to alarm situations being provided.

2. A device as claimed in claim 1, further comprising guiding means (5) for said banknotes (4) comprising guiding sides (5*a*), and wherein said slotted channels (18*a*) are produced in said guiding sides (5*a*).

3. A device as claimed in claim 1, further comprising a grooved plate (18*b*) interposed between said banknotes (4) and said ignition unit (15), said slotted channels (18*a*) being produced in said grooved plate (18*b*).

4. A device as claimed in claim 1, wherein said ignition unit (15) is positioned in proximity to an edge of said banknotes (4).

5. A device as claimed in claim 1, wherein said ignition unit (15) comprises a shell (15*a*) and an ignitable substance (15*b*) inserted in said shell (15*a*), said shell (15*a*) having at least one outlet mouth for a flame directed at said banknotes (4).

6. A device as claimed in claim 5, wherein said ignitable substance (15*b*) is a pyrotechnic powder charge.

7. A device as claimed in claim 1, further comprising restricting means (17) for said flame generated by said ignition unit (15), and wherein said restricting means (17) are defined by active protection members (6) comprising at least one extinguishing device (6*a*) suitable to deliver an extinguishing fluid at the level of said banknotes (4).

8. A device as claimed in claim 7, wherein said restricting means (17) are defined by active protection members (6) comprising said extinguishing device (6*a*) suitable to deliver an extinguishing fluid and a staining device (6*b*) to deliver a staining fluid, and wherein said fluids are delivered together to said banknotes (4).

9. A device as claimed in claim 8, further comprising activation means (16) for said ignition unit (15), and wherein said activation means are interlocked with said active protection members (6), such that actuation of said active protection members (6) determines actuation of said activation means (16).

10. A device as claimed in claim 1, further comprising activation means (16) for said ignition unit (15), comprising a detonator (19) which can be activated electrically.

11. A device as claimed in claim 10, wherein at least one activation sensor (21) of said detonator (19) is provided, and wherein said activation sensor (21) is a receiver for alarms.

12. A device as claimed in claim 10, wherein said equipped unit (3) comprises an electric accumulator (20) connected to said detonator (19), and an activation sensor (21) inserted between said detonator (19) and said electric accumulator (20) and suitable to allow passage of electric current in the presence of pre-established conditions in said equipped unit, are provided in said equipped unit.

13. A device as claimed in claim 12, wherein said activation sensor (21) is a pressure switch to detect the delivery of a pressurized fluid sent from active protection members (6).

14. A device to invalidate banknotes in a unit equipped for storage thereof, said equipped unit including banknotes (4) forming at least one orderly group, and said device comprising at least one ignition unit (15) placed in said equipped unit (3) in a position adjacent to said banknotes (4) and suitable to generate a flame producing on at least one of said banknotes (4) localized burns (4*a*) of a pre-established and identifiable type, activation means (16) of said ignition unit (15) sensitive to alarm situations, restricting means (17) of said flame, active protection members (6) defining said restricting means (17) and interlocked with said activation means (16), actuation of said active protection members (6) determining actuation of said activation means (16).

15. A process to invalidate banknotes in a unit equipped for the storage thereof, said equipped unit including banknotes (4) forming at least one orderly group and being connected to active protection members (6) comprising at least one extinguishing device (6*a*) suitable to deliver an extinguishing fluid at the level of said banknotes (4), the process consisting in producing, in alarm situations, localized burns (4*a*), of a pre-established and identifiable type on at least one of said banknotes (4), said localized burns being activated by actuation of said active protection members.

* * * * *